US008770554B2

(12) United States Patent
Kwon et al.

(10) Patent No.: US 8,770,554 B2
(45) Date of Patent: Jul. 8, 2014

(54) GENERATOR OF OXYGEN-RICH WATER

(75) Inventors: Sang Oh Kwon, Seoul (KR); Jae Young Hwang, Suwon-si (KR)

(73) Assignee: Hifil Tech Inc., Yongin-Si, Gyeonggi-Do (KR)

( * ) Notice: Subject to any disclaimer, the term of this patent is extended or adjusted under 35 U.S.C. 154(b) by 351 days.

(21) Appl. No.: 13/366,110

(22) Filed: Feb. 3, 2012

(65) Prior Publication Data

US 2012/0299206 A1 Nov. 29, 2012

(30) Foreign Application Priority Data

May 24, 2011 (KR) ..... 10-2011-0049084

(51) Int. Cl.
*B01F 3/04* (2006.01)

(52) U.S. Cl.
USPC ..... 261/29; 261/34.1; 210/198.1

(58) Field of Classification Search
USPC ..... 261/29, 34.1; 210/198.1
See application file for complete search history.

(56) References Cited

FOREIGN PATENT DOCUMENTS

| | | | |
|---|---|---|---|
| JP | 3019784 U | | 1/1996 |
| JP | 2005127592 A | * | 5/2005 |
| KR | 10-0935206 B1 | | 1/2010 |

* cited by examiner

*Primary Examiner* — Robert A Hopkins
(74) *Attorney, Agent, or Firm* — Birch, Stewart, Kolasch & Birch, LLP

(57) ABSTRACT

Disclosed is a generator of oxygen-rich water. An exemplary embodiment of the present invention provides a generator of oxygen-rich water, including: a housing; a water tank provided in the housing; an oxygen generator provided in the housing; and a mixing unit mixing water supplied from the water tank and oxygen generated from the oxygen generator, wherein the mixing unit includes a hollow fiber membrane therein, and the hollow fiber membrane includes an inlet to which at least one end of a hollow fiber is fixed and a protrusion in which a body of the hollow fiber protrudes and is provided so that water and oxygen flows into an opening of at least one end fixed to the inlet and is discharged to the protrusion.

20 Claims, 4 Drawing Sheets

GENERATOR OF OXYGEN-RICH WATER

CROSS-REFERENCE TO RELATED APPLICATIONS

This application claims priority to and the benefit of Korean Patent Application No. 10-2011-0049084 filed in the Korean Intellectual Property Office on May 24, 2011, the entire contents of which are incorporated herein by reference.

TECHNICAL FIELD

The present invention relates to a generator of oxygen-rich water. More particularly, the present invention relates to a generator of oxygen-rich water which has low noise and is capable of efficiently dissolving oxygen in water.

BACKGROUND ART

These days, the importance of water has been spotlighted to the point where water is the most important factor of the secret of longevity, and as a result, public interest in water has increased. Various waters such as the water in predetermined areas, deep ocean water, oxygen-rich water, alkaline water, and the like have been gradually commercialized and sold. Interest in the oxygen-rich water among various kinds of waters has also increased and an attempt to a method for efficiently producing the oxygen-rich water has been made.

In one of known methods for increasing dissolved oxygen in water, while water and oxygen are charged in an airtight container and pressurized, water and oxygen were left for a long time to dissolve the oxygen. However, since a sturdy tank, a high-lift valve pump, and a high-pressure oxygen tank are required to implement this method, the volume and weight of a system increase and a unit production cost of oxygen-rich water increases. Therefore, when oxygen is dissolved in drinking water in a small-scale apparatus such as a water purifying filter or an oxygen-rich water generator, this method cannot be applied due to the volume and weight, a production cost, and the like.

Further, one of method for dissolving oxygen in water increases a contact area between oxygen and water by consecutively inputting gas with sufficient oxygen into water. Dissolution efficiency is low to dissolve oxygen approximately at saturation concentration in this method, but this method cannot be applied to an application field requiring supersaturation.

SUMMARY OF THE INVENTION

The present invention has been made in an effort to provide a generator of oxygen-rich water which has low noise and is capable of efficiently dissolving oxygen in drinking water and a water purifier, a drinking water device, or a water cooler including the same.

An exemplary embodiment of the present invention provides a generator of oxygen-rich water, including: a housing; a water tank provided in the housing; an oxygen generator provided in the housing; and a mixing unit mixing water supplied from the water tank and oxygen generated from the oxygen generator, wherein the mixing unit includes a hollow fiber membrane therein, and the hollow fiber membrane includes an inlet to which at least one end of a hollow fiber is fixed and a protrusion in which a body of the hollow fiber protrudes and is provided so that water and oxygen flows into an opening of at least one end fixed to the inlet and is discharged to the protrusion.

Another exemplary embodiment of the present invention provides a water purifier, a drinking water device, and a water cooler including the oxygen-rich water generator.

According to exemplary embodiments of the present invention, a generator of oxygen-rich water has low noise because a nozzle causing large noise is not used, can efficiently dissolve oxygen, and includes a hollow fiber membrane having a long life-span.

DETAILED DESCRIPTION

Figure 1:
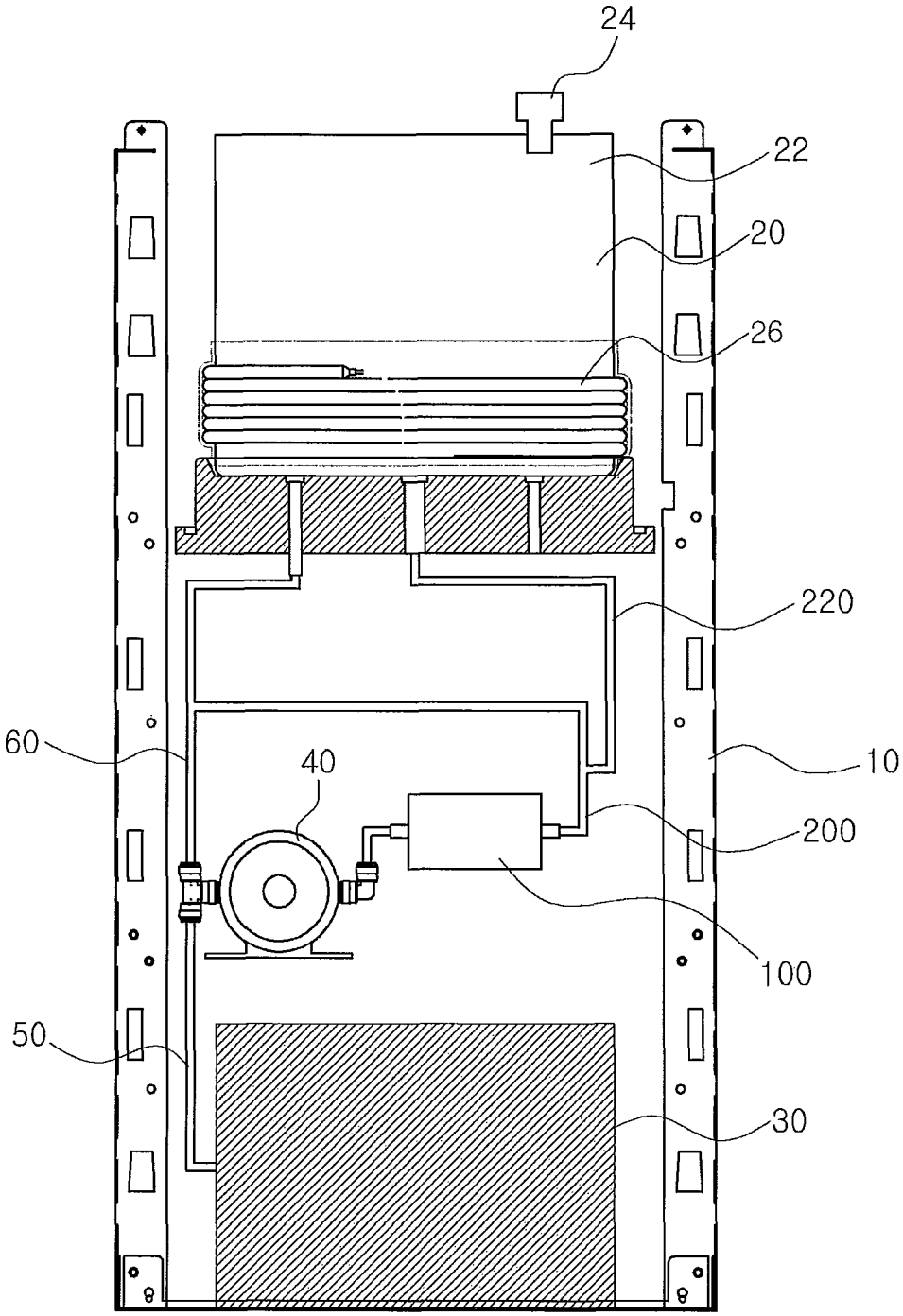
FIG. 1 is a cross-sectional view according to an exemplary embodiment of the present invention.

A generator of oxygen-rich water according to an exemplary embodiment of the present invention includes a housing, a water tank, an oxygen generator, a mixing unit, and a hollow fiber membrane and the hollow fiber membrane includes an inlet and a protrusion.

Another generator of oxygen-rich water according to an exemplary embodiment of the present invention may include a first water pipe and a second water pipe and may further include a pump. Further, the generator of oxygen-rich water may include a cover that blocks the top of the water tank and includes a through-hole penetrating a part thereof and may further include a filter part covering the through-hole.

The housing includes the water tank containing water, an oxygen generator supplying oxygen, and a mixing unit mixing the water supplied from the water tank and the oxygen generated from the oxygen generator therein and may further include a pump pressurizing the water and oxygen therein that flow in the mixing unit. The pump is positioned in the housing and serves to pressurize the water and oxygen that flow in the mixing unit. Further, the water and oxygen that flow in the pump are primarily mixed while passing through the pump and move to the mixing unit.

The pump used in this case, which has a pressure of 0.1 to 6 atmospheric pressure, inappropriately has a problem in that it is difficult for the water and the oxygen to pass through a hollow fiber of the mixing unit when the pressure is lower than 0.1 atmospheric pressure and noise and vibration become larger when the pressure is higher than 6 atmospheric pressure.

The housing is constituted by a single case or two or more cases and when the housing is used as a small oxygen-rich water generator, the housing is preferably manufactured as the single case. Further, the housing is made of general materials such as plastic, metal, ceramics, and the like, which are known in the art and the material of the housing is not limited thereto.

The housing as a module that receives water from the outside may have different structures depending on a method of receiving water through a bottled bottle or a method of receiving tap water that passes through a water purifying filter. When the water is received through the bottled bottle, the housing should have a module for fixing the bottle and a supply passage for supplying water to the water tank from the bottle and may have a control module for controlling the amount of water stored in the water tank to be constant in the supply passage. Meanwhile, when the tap water is received through the water supply, a pipe connected with a water supply facility is provided and one end of the pipe is connected with the water purifying filter installed inside or outside the housing. Further, the tap water that passes through the water purifying filter moves to the water tank and the control module for controlling the amount of the water stored in the water tank to be constant may be provided. The control module may be positioned on a pipe connecting the water supply facility and the water purifying filter or a pipe connecting the water purifying filter and the water tank. The housing is manufactured by a general method which is known to the related art and the manufacturing method of the housing is not limited thereto.

The water tank is positioned in the housing and contains water. The water is received in the housing through the bottled bottle or the tap water passing through the water purifying filter is received.

The water tank may be blocked with the cover positioned on the top. In this case, bacteria which flow in from outdoor air may be prevented from being permeated through the filter part covering the through-hole provided in the cover and the filter part is attachable and detachable.

The water contained in the water tank moves to the mixing unit through a water supply pipe and the water may move to the mixing unit through the pump pressurizing the water into the mixing unit.

The oxygen-rich water passing through the mixing unit flows into the water tank and the water tank may include a cooling module provided on an outer surface of the water tank so that oxygen of the oxygen-rich water which flows in is stably dissolved in water to be maintained cool. The oxygen-rich water generator with the cooling module provided on the outer surface of the water tank corresponds to a water cooler and a structure and an installation position of the cooling module are configured according to the general method which is known to the art, but not limited thereto.

The oxygen generator is provided in the housing and generates oxygen to be supplied to the oxygen-rich water generator. The oxygen generated through the oxygen generator moves to the mixing unit through an air passing tube and the oxygen moves to the mixing unit through the pump pressurizing the oxygen into the mixing unit. In this case, the pump is positioned in the housing and serves to pressurize the water and oxygen that flows in the mixing unit. Further, while passing through the pump, the water and the oxygen that flow into the pump may be primarily mixed so that the oxygen is mixed with the water in a drop form.

Meanwhile, the mixing unit is provided in the housing and the water supplied from the water tank and the oxygen supplied from the oxygen generator flow into the mixing unit. While the water and the oxygen pass through the pump, the oxygen may be mixed with the water in the drop form and flow into an inlet of the mixing unit while the water and the oxygen are pressurized by the pump.

The mixing unit includes the hollow fiber membrane therein and the hollow fiber membrane includes an inlet to which at least one end of the hollow fiber is fixed and the protrusion in which a body of the hollow fiber protrudes. The hollow fiber is a chemical fiber in which a passage is provided at the center of a cross section of a fiber. In this case, one end of the fiber is connected to the other end so that fluid flows through the passage. Further, a plurality of minute holes having a diameter in the range of 0.001 to 10 μm are provided in the body of the hollow fiber, such that liquid and gas can pass through the minute holes.

In the hollow fiber membrane, the other end of the hollow fiber may be sealed or both ends may be fixed to the inlet like the one end. The hollow fiber membrane may be manufactured by a hollow fiber membrane constituted by a hollow fiber of which only one end is fixed, a hollow fiber membrane constituted by a hollow fiber of which both ends are fixed, or a hollow fiber membrane in which the hollow fiber with the one fixed end and the hollow fiber with both fixed ends are mixed.

While the drop shaped oxygen mixed with the water flows into the inlet and passes through the minute holes formed in the body of the hollow fiber, the size of the oxygen drop becomes smaller than that before passing through the protrusion. The reason is that the oxygen drop is finely spilt while passing through the minute holes formed in the body of the hollow fiber at the time of passing through the protrusion.

As a contact area of the finely split oxygen drops with the water increases, the oxygen drops can be well dissolved in the water. In this case, a stabilization pipe connected to an outlet of the mixing unit may be provided so that minute oxygen drops having various sizes are completely dissolved in the water. The stabilization pipe may have a linear type or a coil type and may be manufactured as a type generally used in the art and the type is not limited. The dissolved oxygen density of the oxygen-rich water prepared by the above method is in the level in the range of 50 to 200 ppm which is significantly over a saturation density in the range of 7 to 15 ppm. Therefore, very high-density oxygen-rich water is provided.

As another method for installing the hollow fiber membrane in the mixing unit, the hollow fiber membrane provided in the generator of oxygen-rich water includes the inlet to which one end or both ends of the hollow fiber are fixed and the protrusion in which the body of the hollow fiber protrudes and in the case where the water including the oxygen flows into the protrusion and is discharged to the inlet, when the water flows in the protrusion, the water is discharged while the water flows through a cavity of the hollow fiber by passing through the minute holes formed in the body of the hollow fiber.

However, in the above method, when the difference between the pressure of the water before the water flows in the hollow fiber membrane and the pressure of the water after the water passes through the hollow fiber membrane is large, deformation in which the body of the hollow fiber of the protrusion is pressed occurs, such that the oxygen-rich water cannot smoothly pass through the hollow fiber membrane and the life-span of the hollow fiber membrane is shortened. Further, when the body of the hollow fiber of the protrusion is deformed, an excessive pressure is applied to the hollow fiber membrane, and as a result, even the pump pressurizing water and gas that flow in is strained.

Meanwhile, unlike the above method, the hollow fiber membrane of the present invention includes the inlet to which at least one end of the hollow fiber is fixed and the protrusion in which the body of the hollow fiber protrudes and is installed so that the water including the oxygen flows into the inlet and is discharged to the protrusion.

In this case, in the hollow fiber membrane, the other end of the hollow fiber may be sealed or both ends may be fixed to the inlet like the one end.

The hollow fiber membrane may be manufactured by a hollow fiber membrane constituted by a hollow fiber of which only one end is fixed, a hollow fiber membrane constituted by a hollow fiber of which both ends are fixed, or a hollow fiber membrane in which the hollow fiber with the one fixed end and the hollow fiber with both fixed ends are mixed.

As another method of installing the hollow fiber membrane in the mixing unit, in the hollow fiber membrane provided in the oxygen-rich water generator, when the water including the oxygenflows into the protrusion and is discharged to the inlet, the pressure of the water and the size of the oxygen drop should be well controlled to prevent the excessive pressure from being applied to or a too large oxygen drop from being close to the body of the hollow fiber of the protrusion and to this end, a nozzle is preferably installed at the inlet to control the pressure of the water and reduce the size of the oxygen drop.

However, there is a limit in placement in which the inlet with the nozzle should be placed above the outlet without the nozzle on the basis of the ground so that the water passing through the nozzle in the mixing unit drops from top to bottom on the basis of the ground in the mixing unit and noise may be generated due to the actuation of the nozzle.

Meanwhile, in the hollow fiber membrane of the present invention, the water including the oxygen flows into the inlet and is discharged to the protrusion and an additional nozzle does not need to be installed at the inlet because the need for controlling the pressure of the water that flows into the hollow fiber membrane and the size of the oxygen drop is smaller than the above-mentioned method, and as a result, noise generated from oxygen-rich water generator is reduced. In addition, since the mixing unit of the present invention does not have the limit in placement caused due to the installation of the nozzle in the above-mentioned method, the position of the mixing unit in the housing is easily changeable.

In the present invention, the oxygen-rich water generator may further include a first water pipe and a second water pipe.

One end of the first water pipe is connected to the outlet of the mixing unit and one end of the second water pipe is joined to a hole formed on the side of the first water pipe. Further, the first water pipe is installed so as to allow oxygen-rich water passing through the mixing unit to move from bottom to top on the basis of the ground and one end of the second water pipe is joined to one point on a path where the oxygen-rich water moves from bottom to top on the basis of the ground.

The larger the size of the oxygen drop contained in the oxygen-rich water passing through the first water pipe is, the higher the movement speed of the large oxygen drop is. Relatively smaller oxygen drops are low in movement speed due to a speed difference depending on the drop size. In this case, the small oxygen drops passing through the first water pipe moves to the second water pipe in which the small oxygen drop move more easily at a contact point connected with the second water pipe.

The oxygen-rich water that moves through the first water pipe and contains the large oxygen drops passes through the mixing unit again to move so that the oxygen-rich water is split into the smaller oxygen drops. The other end of the first water pipe is connected to any one of the water supply pipe, the pump, and the mixing unit to allow the oxygen-rich water containing the large oxygen drops to reach the mixing unit.

The oxygen-rich water that moves through the second water pipe and contains the small oxygen drops finally moves to the water tank with the cooling module or an additional oxygen-rich water storing tank.

The water tank that receives the oxygen-rich water stably contains the oxygen-rich water containing oxygen through the cooling module and a user receives the oxygen-rich water contained in the water tank or the oxygen-rich water storing tank through a supply module.

The oxygen-rich water generator is applied as a drinking water device that includes the oxygen-rich water generator of the present invention and receives water from the outside through the bottled bottle, a water purifier that includes the oxygen-rich water generator of the present invention and receives the tap water from the outside through the water purifying filter, and a cooler that includes the oxygen-rich water generator of the present invention and maintains the water stored in the water tank cool with the cooling module.

Hereinafter, exemplary embodiments of the present disclosure will be described in detail with reference to the accompanying drawings.

Figure 2:
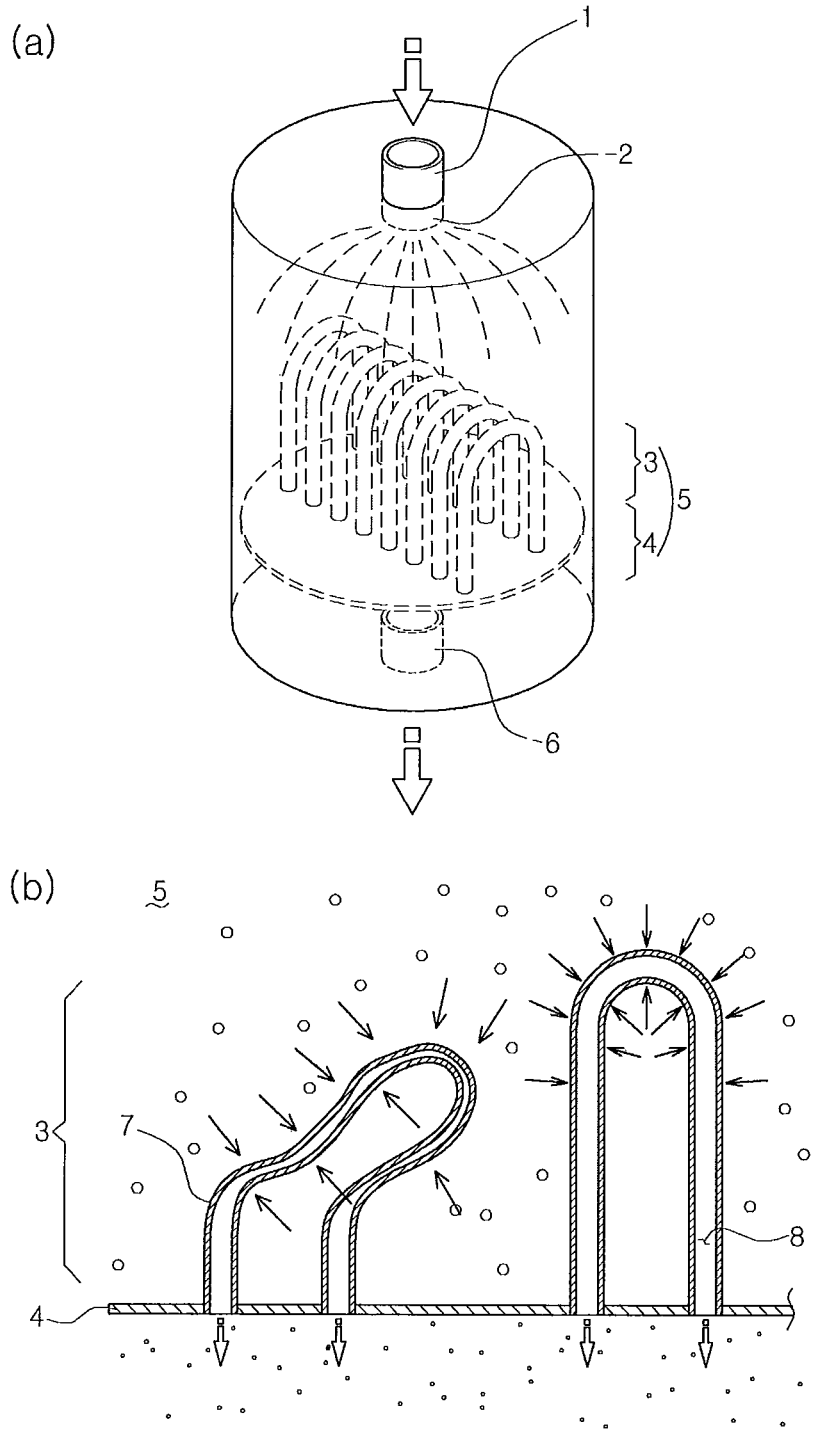
FIG. 2 is a perspective view of a mixing unit and a patterned diagram of fluid flow in the mixing unit according to another exemplary embodiment of the present invention.
Figure 3:
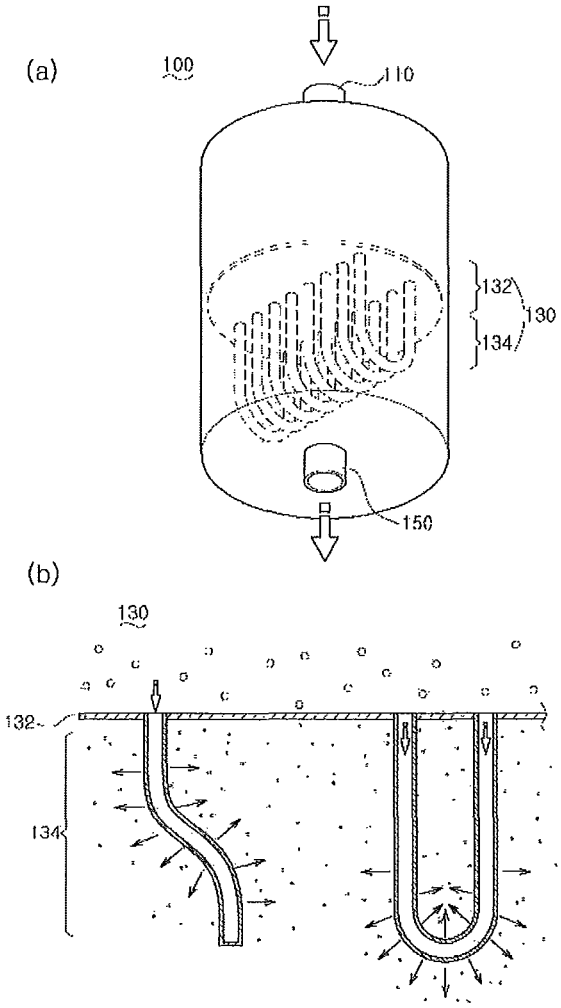
FIG. 3 is a perspective view of a mixing unit and a patterned diagram of fluid flow in the mixing unit according to an exemplary embodiment of the present invention.
Figure 4:
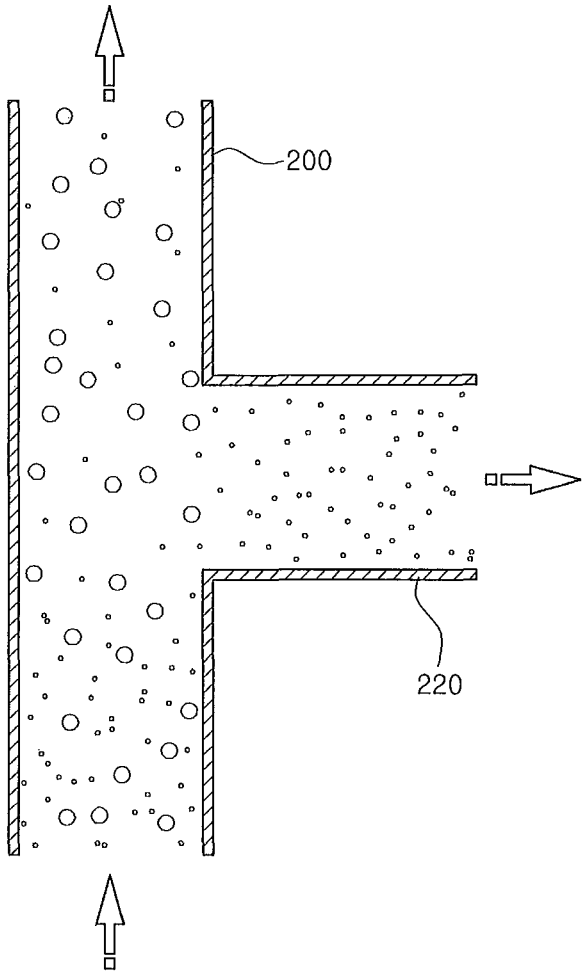
FIG. 4 is a patterned diagram of fluid flow in first and second water pipes according to an exemplary embodiment of the present invention.

FIG. 1 is a cross-sectional view according to an exemplary embodiment of the present invention, FIG. 2 is a perspective view of a mixing unit and a patterned diagram of fluid flow in the mixing unit according to another exemplary embodiment of the present invention, FIG. 3 is a perspective view of a mixing unit and a patterned diagram of fluid flow in the mixing unit according to an exemplary embodiment of the present invention, and FIG. 4 is a patterned diagram of fluid flow in first and second water pipes according to an exemplary embodiment of the present invention.

As shown in FIGS. 1 to 4, the oxygen-rich water generator according to the exemplary embodiment of the present invention includes a housing 10, a water tank 20, an oxygen generator 30, a mixing unit 100, and a hollow fiber membrane 130 and the hollow fiber membrane 130 includes an inlet 132 and a protrusion 134.

Another generator of oxygen-rich water according to the exemplary embodiment of the present invention may include a first water pipe 200 and a second water pipe 220 and may further include a pump 40. Further, the generator of oxygen-rich water according to the exemplary embodiment of the present invention may include a cover 22 that blocks the top of the water tank 20 and includes a through-hole penetrating a part thereof and may further include a filter part 24 covering the through-hole.

The housing 10 includes the water tank 20 containing water, the oxygen generator 30 supplying oxygen, and the mixing unit 100 mixing the water supplied from the water tank and the oxygen generated from the oxygen generator therein as shown in FIG. 1 and may further include the pump 40 pressurizing the water and oxygen that flows in the mixing unit. The pump 40 is positioned in the housing 10 and serves to pressurize the water and oxygen that flows in the mixing unit. Further, the water and the oxygen that flow in the pump 40 are primarily mixed while passing through the pump and move to the mixing unit.

The housing 10 is constituted by a single case or two or more cases and when the housing is used as a small oxygen-rich water generator, the housing is preferably manufactured as the single case. Further, the housing is made of general materials such as plastic, metal, ceramics, and the like, which are known in the art and the material of the housing are not limited thereto.

The housing 10 may have different structures depending on a module that receives water from the outside, a method of receiving water through a bottled bottle or a method of receiving tap water that passes through a water purifying filter. When the water is received through the bottled bottle, the housing should have a module for fixing the bottle and a supply passage for supplying water to the water tank from the bottle and may have a control module for controlling the amount of water stored in the water tank to be maintained constant in the supply passage. Meanwhile, when the tap water is received through the water supply, a pipe connected with a water supply facility is provided and a partial end of the pipe is connected with the water purifying filter installed inside or outside the housing 10. Further, the tap water that passes through the water purifying filter moves to the water tank and the control module for controlling the amount of the water stored in the water tank to be maintained constant may be provided. The control module may be positioned on a pipe connecting the water supply facility and the water purifying filter or a pipe connecting the water purifying filter and the water tank. The housing 10 is manufactured by a general method which is known to the related art and the manufacturing method of the housing is not limited thereto.

The water tank 20 is positioned in the housing 10 and contains water as shown in FIG. 1. The water is received in the housing through the bottled bottle or the tap water passing through the water purifying filter is received.

The water tank 20 may be blocked with the cover 22 positioned on the top as shown in FIG. 1. In this case, bacteria which flow in from outdoor air may be prevented from being permeated through the filter part 24 covering the through-hole provided in the cover and the filter part is attachable and detachable.

The water contained in the water tank 20 moves to the mixing unit 100 through a water supply pipe 60 as shown in FIG. 1 and the water may move to the mixing unit through the pump 40 pressurizing the water.

The oxygen-rich water passing through the mixing unit flows into the water tank 20 through the second water pipe 220 as shown in FIG. 1 and the water tank 20 may include a cooling module 26 provided on an outer surface of the water tank so that oxygen of the oxygen-rich water which flows in is stably dissolved in water to be maintained cool. The oxygen-rich water generator with the cooling module 26 provided on the outer surface of the water tank corresponds to a water cooler and a structure and an installation position of the cooling module are configured according to the general method which is known to the art, but not limited thereto.

The oxygen generator 30 is provided in the housing as shown in FIG. 1 and generates oxygen to be supplied to the oxygen-rich water generator. The oxygen generated through the oxygen generator moves to the mixing unit 100 through an air passing tube 50 and the oxygen moves to the mixing unit through the pump 40 pressurizing the oxygen into the mixing unit. In this case, the pump 40 is positioned in the housing 10 and serves to pressurize the water and oxygen that flows in the mixing unit. Further, while passing through the pump 40, the water and the oxygen that flows into the pump 40 may be primarily mixed so that the oxygen is mixed with the water in a water drop form.

Meanwhile, the mixing unit 100 is provided in the housing and the water supplied from the water tank as shown in FIG. 1 and the oxygen supplied from the oxygen generator flow into the mixing unit. While the water and the oxygen pass through the pump 40, the oxygen may be mixed with the water in the drop form as shown in FIGS. 1 and 3A and flow into an inlet 110 of the mixing unit 100 while the water and the oxygen are pressurized by the pump 40.

The mixing unit 100 includes the hollow fiber membrane 130 and the hollow fiber membrane 130 includes an inlet 132 to which at least one end of the hollow fiber is fixed and a protrusion 134 in which a body of the hollow fiber fixed to the inlet protrudes as shown in FIGS. 3A and 3B. The hollow fiber is a chemical fiber in which a passage is provided at the center of a cross section of a fiber and the passage is connected from one end of the fiber to the other end so that fluid flows through the passage.

In the hollow fiber membrane 130, the other end of the hollow fiber may be sealed or both ends may be fixed to the inlet like the one end as shown in FIG. 3B.

The hollow fiber membrane may be manufactured by a hollow fiber membrane constituted by a hollow fiber of which only one end is fixed, a hollow fiber membrane constituted by a hollow fiber of which both ends are fixed, or a hollow fiber membrane in which the hollow fiber with the one fixed end and the hollow fiber with both fixed ends are mixed.

A plurality of minute holes having a diameter in the range of 0.001 to 10 μm are provided in the body of the hollow fiber, such that liquid and gas can pass through the minute holes.

While the drop shaped oxygen mixed with the water flows into the inlet 132 and passes through the minute holes formed in the body of the hollow fiber, the size of the oxygen drop becomes smaller than that before passing through the protrusion 134. The reason is that the oxygen is finely spilt while passing through the minute holes formed in the body of the hollow fiber at the time of passing through the protrusion 134.

A contact area of the finely split oxygen drops with the water increases to well dissolve the oxygen drops in the water and the dissolved oxygen density of the oxygen-rich water prepared by the above method is in the level in the range of 50 to 200 ppm which is significantly over saturation concentration in the range of 7 to 15 ppm. Therefore, very high-density oxygen-rich water is provided. In this case, in order to lengthen the time when the oxygen is dissolved in the water, a stabilization pipe (not shown) connected to the outlet 150 of the mixing unit may be provided by a routine method and the method is not limited.

As another method for installing the hollow fiber membrane in the mixing unit, the hollow fiber membrane 5 provided in the oxygen-rich water generator includes an inlet 4 to which at least one end of the hollow fiber is fixed and a protrusion 3 in which a body 7 of the hollow fiber protrudes and in the case where the water including the oxygen flows into the protrusion 3 and is discharged to the inlet 4, when the water is injected into the protrusion 3, the water is discharged while the water flows through a cavity 8 of the hollow fiber by passing through the minute holes formed in the body 7 of the hollow fiber as shown in FIGS. 2A and 2B.

However, in the above method, when the difference between the pressure of the water before the water flows in the hollow fiber membrane and the pressure of the water after the water passes through the hollow fiber membrane is large, the body 7 of the hollow fiber of the protrusion 3 is deformed, such that the oxygen-rich water cannot smoothly pass through the hollow fiber membrane 5 and the life-span of the hollow fiber membrane is shortened as shown in FIG. 2B. Further, as shown in FIG. 2B, when the body 7 of the hollow fiber of the protrusion 3 is deformed, an excessive pressure is applied to the hollow fiber membrane, and as a result, even the pump pressuring water and gas that flow in is strained.

Therefore, unlike the above method, the hollow fiber membrane 130 of the present invention includes the inlet 132 to which at least one end of the hollow fiber is fixed and the protrusion 134 in which the body of the hollow fiber fixed to the inlet protrudes and is installed so that the water including the oxygen flows into the inlet 132 and is discharged to the protrusion 134 as shown in FIGS. 3A and 3B.

In this case, in the hollow fiber membrane 130, the other end of the hollow fiber may be sealed or both ends may be fixed to the inlet like the one end as shown in FIG. 3.

The hollow fiber membrane 130 may be manufactured by a hollow fiber membrane constituted by a hollow fiber of which only one end is fixed, a hollow fiber membrane constituted by a hollow fiber of which both ends are fixed, or a hollow fiber membrane in which the hollow fiber with the one fixed end and the hollow fiber with both fixed ends are mixed.

As another method of installing the hollow fiber membrane in the mixing unit, in the hollow fiber membrane 5 provided in the oxygen-rich water generator, when the water including the oxygen flows into the protrusion 3 and is discharged to the inlet 4, the pressure of the water and the size of the oxygen drop should be well controlled to prevent the excessive pressure from being applied to or a too large oxygen drop from being close to the body 7 of the hollow fiber of the protrusion 3 and to this end, a nozzle 2 is preferably installed at an inlet 1 to control the pressure of the water and reduce the size of the oxygen drop, as shown in FIGS. 2A and 2B.

However, there is a limit in placement in which the inlet 1 with the nozzle 2 should be placed above the outlet 150 without the nozzle on the basis of the ground so that the water passing through the nozzle 2 in the mixing unit drops from top to bottom on the basis of the ground in the mixing unit and noise may be generated due to the actuation of the nozzle 2.

Meanwhile, in the hollow fiber membrane 130 of the present invention, the water including the oxygen flows into the inlet 132 and is discharged to the protrusion 134 and an additional nozzle does not need to be installed at the inlet 110 because the need for controlling the pressure of the water that flows into the hollow fiber membrane 130 and the size of the oxygen drop is smaller than the above-mentioned method, and as a result, noise generated from the oxygen-rich water generator is reduced as shown in FIGS. 3A and 3B. In addition, since the mixing unit 100 of the present invention does not have the limit in placement caused due to the installation of the nozzle in the above-mentioned method, the position of the mixing unit in the housing 10 is easily changeable.

In the present invention, the oxygen-rich water generator may further include a first water pipe 200 and a second water pipe 220.

One end of the first water pipe 200 is connected to the outlet 150 of the mixing unit and one end of the second water pipe is joined to a hole formed on the side of the first water pipe 200 as shown in FIGS. 1 and 4. Further, the first water pipe 200 is installed so as to allow oxygen-rich water passing through the mixing unit 100 to move from bottom to top on the basis of the ground and one end of the second water pipe 220 is joined to one point on a path where the oxygen-rich water moves from bottom to top on the basis of the ground.

The larger the size of the oxygen drop contained in the oxygen-rich water passing through the first water pipe 200 is, the higher the movement speed of the large oxygen drop is. Relatively smaller oxygen drops are low in movement speed due to a speed difference depending on the drop size. In this case, the small oxygen drops passing through the first water pipe 200 moves to the second water pipe 220 in which the small oxygen drop move more easily at a contact point connected with the second water pipe 220 as shown in FIG. 4.

The oxygen-rich water that moves through the first water pipe 200 and contains the large oxygen drops passes through the mixing unit 100 again to move so that the oxygen-rich water is split into the smaller oxygen drops as shown in FIG. 1. The other end of the first water pipe is connected to any one of the water supply pip 60, the pump 40, and the mixing unit 100 to allow the oxygen-rich water containing the large oxygen drops to reach the mixing unit 100.

The oxygen-rich water that moves through the second water pipe 220 and contains the small oxygen drops finally moves to the water tank 20 with the cooling module 260 or an additional oxygen-rich water storing tank as shown in FIG. 1.

The water tank 20 that receives the oxygen-rich water stably contains the oxygen-rich water containing oxygen through the cooling module 26 and a user receives the oxygen-rich water contained in the water tank 20 or the oxygen-rich water storing tank through a supply module (not shown).

The oxygen-rich water generator is applied as a drinking water device that includes the oxygen-rich water generator of the present invention and receives water from the outside through the bottled bottle, a water purifier that includes the oxygen-rich water generator of the present invention and receives the tap water from the outside through the water purifying filter, and a cooler that includes the oxygen-rich water generator of the present invention and maintains the water stored in the water tank cool with the cooling module.

What is claimed is:

1. A generator of oxygen-rich water, comprising:
- a housing;
- a water tank provided in the housing;
- an oxygen generator provided in the housing; and
- a mixing unit mixing water supplied from the water tank and oxygen generated from the oxygen generator,
- wherein the mixing unit includes a hollow fiber membrane therein, and the hollow fiber membrane includes an inlet to which at least one end of a hollow fiber is fixed and a protrusion in which a body of the hollow fiber protrudes and is provided so that water and oxygen flows into an opening of at least one end fixed to the inlet and is discharged to the protrusion.

2. The generator of oxygen-rich water according to claim 1, wherein in the hollow fiber membrane, the other end of the hollow fiber is sealed.

3. The generator of oxygen-rich water according to claim 1, wherein the hollow fiber membrane includes an inlet to which both ends of a hollow fiber are fixed and a protrusion in which the body of the hollow fiber protrudes.

4. The generator of oxygen-rich water according to claim 1, further comprising:
- a first water pipe through which oxygen-rich water discharged from the mixing unit is transported and a second water pipe of which one end is joined to a hole formed on the side of the first water pipe.

5. The generator of oxygen-rich water according to claim 4, wherein the oxygen-rich water moving to the first water pipe passes through the mixing unit again and the oxygen-rich water passing through the second water pipe moves to the water tank.

6. The generator of oxygen-rich water according to claim 4, wherein one end of the first water pipe is connected to an outlet of the mixing unit and the other end of the first water pipe is connected to any one of a water supply pipe connected up to an inlet of the mixing unit from the water tank, a pump pressurizing water and oxygen supplied into the mixing unit, and the inlet of the mixing unit.

7. The generator of oxygen-rich water according to claim 1, further comprising a cover blocking the top of the water tank and including a through-hole penetrating a part thereof and a filter part covering the through-hole.

8. A water purifier, comprising a generator of oxygen-rich water according to claim 1.

9. A drinking water device, comprising a generator of oxygen-rich water according to claim 1.

10. A water cooler, comprising a generator of oxygen-rich water according to claim 1.

11. A water purifier, comprising a generator of oxygen-rich water according to claim 2.

12. A water purifier, comprising a generator of oxygen-rich water according to claim 3.

13. A water purifier, comprising a generator of oxygen-rich water according to claim 4.

14. A water purifier, comprising a generator of oxygen-rich water according to claim 5.

15. A water purifier, comprising a generator of oxygen-rich water according to claim 6.

16. A water purifier, comprising a generator of oxygen-rich water according to claim 7.

17. A drinking water device, comprising a generator of oxygen-rich water generator according to claim 2.

18. A drinking water device, comprising a generator of oxygen-rich water generator according to claim 3.

19. A drinking water device, comprising a generator of oxygen-rich water generator according to claim 4.

20. A drinking water device, comprising a generator of oxygen-rich water generator according to claim 5.

* * * * *